US005262742A

United States Patent [19]

Bentivenga

[11] Patent Number: 5,262,742

[45] Date of Patent: Nov. 16, 1993

[54] HALF-WAVE FOLDED CROSS-COUPLED FILTER

[75] Inventor: Salvatore Bentivenga, Parlin, N.J.

[73] Assignee: Radio Frequency Systems, Inc., Marlboro, N.J.

[21] Appl. No.: 886,371

[22] Filed: May 20, 1992

[51] Int. Cl.[5] ..... H01P 1/205

[52] U.S. Cl. ..... 333/203; 333/206

[58] Field of Search ..... 333/202, 203, 206, 212

[56] References Cited

U.S. PATENT DOCUMENTS

| | | | |
|---|---|---|---|
| 4,216,448 | 8/1980 | Kasuga | 333/203 |
| 4,660,004 | 4/1987 | Jachowski | 333/203 X |

FOREIGN PATENT DOCUMENTS

| | | | |
|---|---|---|---|
| 3329057 | 2/1985 | Fed. Rep. of Germany . | |
| 218102 | 9/1991 | Japan | 333/203 |
| 1427440 | 9/1988 | U.S.S.R. | 333/203 |

*Primary Examiner*—Paul Gensler

*Attorney, Agent, or Firm*—Ware, Fressola, Van Der Sluys & Adolphson

[57] ABSTRACT

A folded high frequency resonant cavity filter 30 includes a filter housing 32 that contains a half-wave resonator rod 36, 64 and a plurality of evanescent mode resonator rods 34, 34'. The half-wave resonator rod 36, 64 and plurality of evanescent mode resonator rods 34, 34' are mounted to the filter housing 32 such that they all lie along a single plane. The filter housing 32 has an inner wall 42 that physically isolates two groups of evanescent mode resonator rods 34, 34' from each other. An aperture 40 is is formed in the inner housing wall 42 between two physically opposing evanescent mode resonator rods 34' to allow a capacitive cross-coupling to occur between the two evanescent mode resonator rods 34'. The capacitive cross-coupling is fine tuned by a tuning rod 44 that is positioned through the inner wall 42 and within the aperture 40. The half-wave resonator rod 36, 64 can be either a shunt half-wave resonator rod 36 or a series half-wave resonator rod 64, whereby the shunt half-wave resonator rod 36 is fine tuned by a tuning disc 46 and the series half-wave resonator rod 64 is fine tuned by a pair of tuning rods 68. Input and output ports 48 are supplied with coupling loops 49 to allow input and output coupling, respectively, with the filter 30.

15 Claims, 9 Drawing Sheets

FIG. 1
(PRIOR ART)
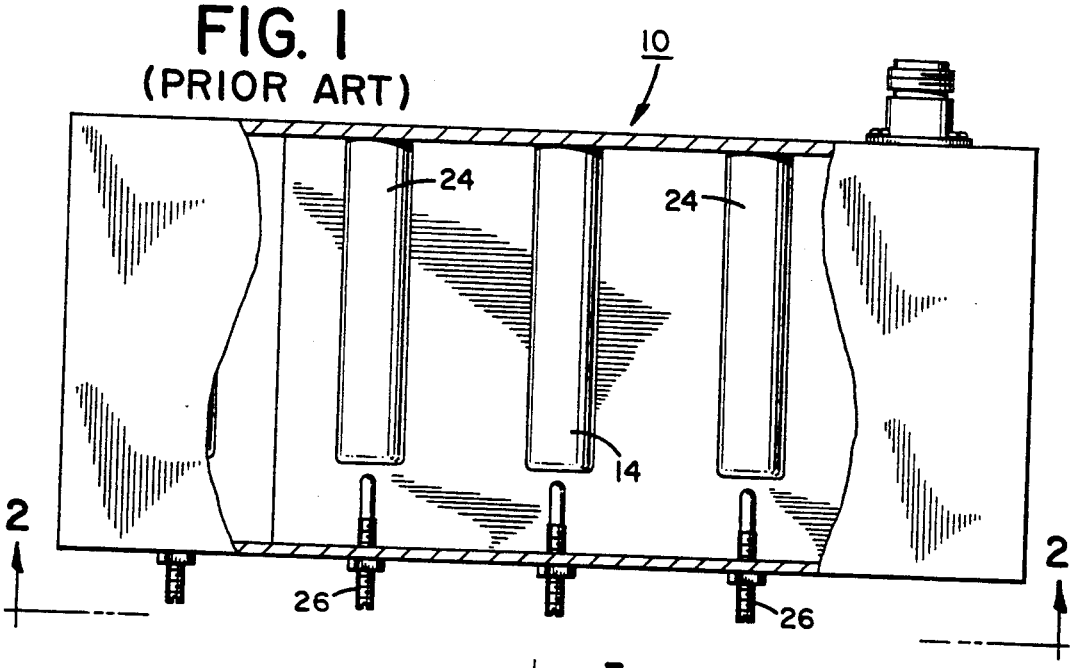
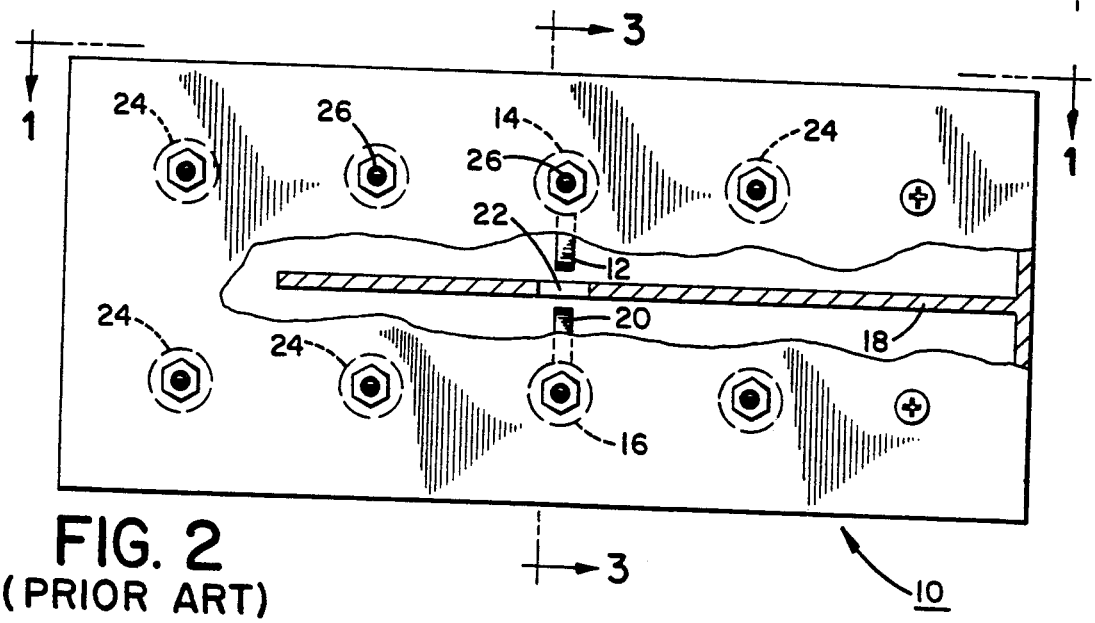
FIG. 2
(PRIOR ART)
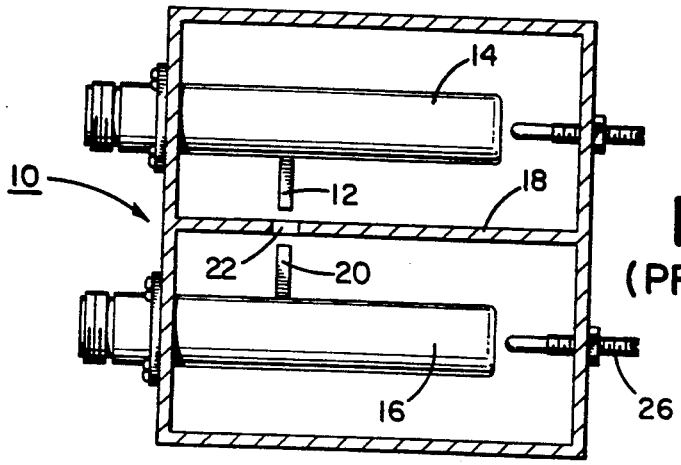
FIG. 3
(PRIOR ART)

| | FREQ MHz | S11 dB | S21 dB |
|---|---|---|---|
| 1.) | 915.000 | -0.05 | -61.77 |
| 2.) | 935.000 | -32.57 | -0.31 |
| 3.) | 960.000 | -28.87 | -0.29 |
| 4.) | 980.000 | -0.17 | -24.97 |

| | FREQ MHz | S11 dB | S21 dB |
|---|---|---|---|
| 1.) | 915.000 | -0.09 | -21.08 |
| 2.) | 935.000 | -21.45 | -0.26 |
| 3.) | 960.000 | -24.39 | -0.35 |
| 4.) | 980.000 | -0.14 | -68.58 |

| FREQ MHz | S11 dB | S21 dB |
|---|---|---|
| 1.) 915.000 | -0.03 | -76.22 |
| 2.) 935.000 | -22.48 | -0.47 |
| 3.) 960.000 | -19.22 | -0.38 |

HALF-WAVE FOLDED CROSS-COUPLED FILTER

BACKGROUND OF THE INVENTION

1. Field of the Invention

The present invention relates to folded high frequency resonant cavity filters and, more particularly, to a high frequency resonant cavity filter that is folded by the use of a half-wave resonator such that capacitive cross-coupling between non-adjacent resonators within the filter is easily attained.

2. Description of the Prior Art

The use of a resonant cavity for high frequency filtering purposes is well known in the art. A resonant cavity housing generally contains a pair of coupling rods and a plurality of resonator rods. The shape of such a housing generally depends upon the number of resonator rods that are required within the housing to obtain a desired filtering characteristic. Also, a resonant cavity housing can be shaped to allow coupling between non-adjacent resonant rods, or capacitive cross-coupling.

Capacitive cross-coupling in resonant cavity filters is primarily used to cause an attenuation of poles at finite frequencies. This allows a decrease in the number of resonator rods that are required to meet a particular bandwidth specification, thereby reducing the required size of the resonant cavity filter housing. Also, since capacitive cross-coupling allows a decrease in the number of resonator rods, fewer finite Q elements are used, thereby decreasing insertion loss. Thus, capacitive cross-coupling in resonant cavity filters allows for a reduction in the size of the resonant cavity filter housing as well as a decrease in insertion loss.

To date, capacitive cross-coupling between non-adjacent resonator rods in resonant cavity filters has been mainly achieved through the use of coupling probes. These coupling probes are either mounted directly to the resonator rods or passed through walls within the resonant cavity housing that separate two or more resonator rods. A resonant cavity filter having coupling probes mounted directly to resonator rods is described in U.S. Pat. No. 4,216,448, entitled, Microwave Distributed-Constant Band-Pass Filter Comprising Projections Adjacent On Capacitively Coupled Resonator Rods to Open Ends Thereof, issued Aug. 5, 1980. A resonant cavity filter having coupling probes that pass through interior resonant cavity housing walls is described in German Patent No. DE3329057A1, issued Jan. 4, 1990. Transmission lines have also been used to couple between non-adjacent resonator rods.

Existing cross-coupled resonant cavity filters have many shortcomings. First, mounting coupling probes directly to resonator rods results in a degradation of resonator Q. Secondly, manufacturing resonant cavity filters having coupling probes tends to be complicated and costly due to a problem of securely attaching the coupling probes to the resonator rods and an increase in the number of assembled parts. Finally, since most existing folded resonant cavity filters are constructed such that all the resonator rods are positioned parallel to one another, the size of such filters occupy a substantial amount of vertical space. It is therefore desirable to overcome these shortcomings in constructing and using folded cross-coupled resonant cavity filters.

SUMMARY OF THE INVENTION

The present invention contemplates a high frequency resonant cavity filter that is constructed to allow non-adjacent resonator rods that are mounted within a resonant cavity housing to capacitively cross-couple without a need for coupling probes. The present invention filter allows for capacitive cross-coupling without coupling probes through the use of a half-wave resonator rod to fold the filter housing. Also, the folding of the filter housing allows all the resonator rods within the housing to lie in the same vertical plane, thereby reducing the amount of vertical space required for the housing. It is thus apparent how the present invention can overcome the above-mentioned shortcomings of existing folded cross-coupled resonant cavity filters.

A primary objective of the present invention is to provide a folded high frequency resonant cavity filter construction that allows cross-coupling between resonator rods without a need for coupling probes.

Another objective of the present invention is to provide a folded high frequency resonant cavity filter construction that reduces the vertical space required of existing folded resonant cavity filters.

BRIEF DESCRIPTION OF THE DRAWINGS

FIG. 1 is a side elevational view of a prior art folded cross-coupled high frequency resonant cavity filter taken along line 1—1 of FIG. 2 with a portion of the housing broken away to illustrate internal structure.

FIG. 2 is a top plan view of a prior art folded cross-coupled high frequency resonant cavity filter taken along line 2—2 of FIG. 1 with a portion of the housing broken away to illustrate internal structure.

FIG. 3 is a cross-sectional view of a prior art folded cross-coupled high frequency resonant cavity filter taken along line 3—of FIG. 2.

DETAILED DESCRIPTION OF THE PREFERRED EMBODIMENTS

Figure 4:
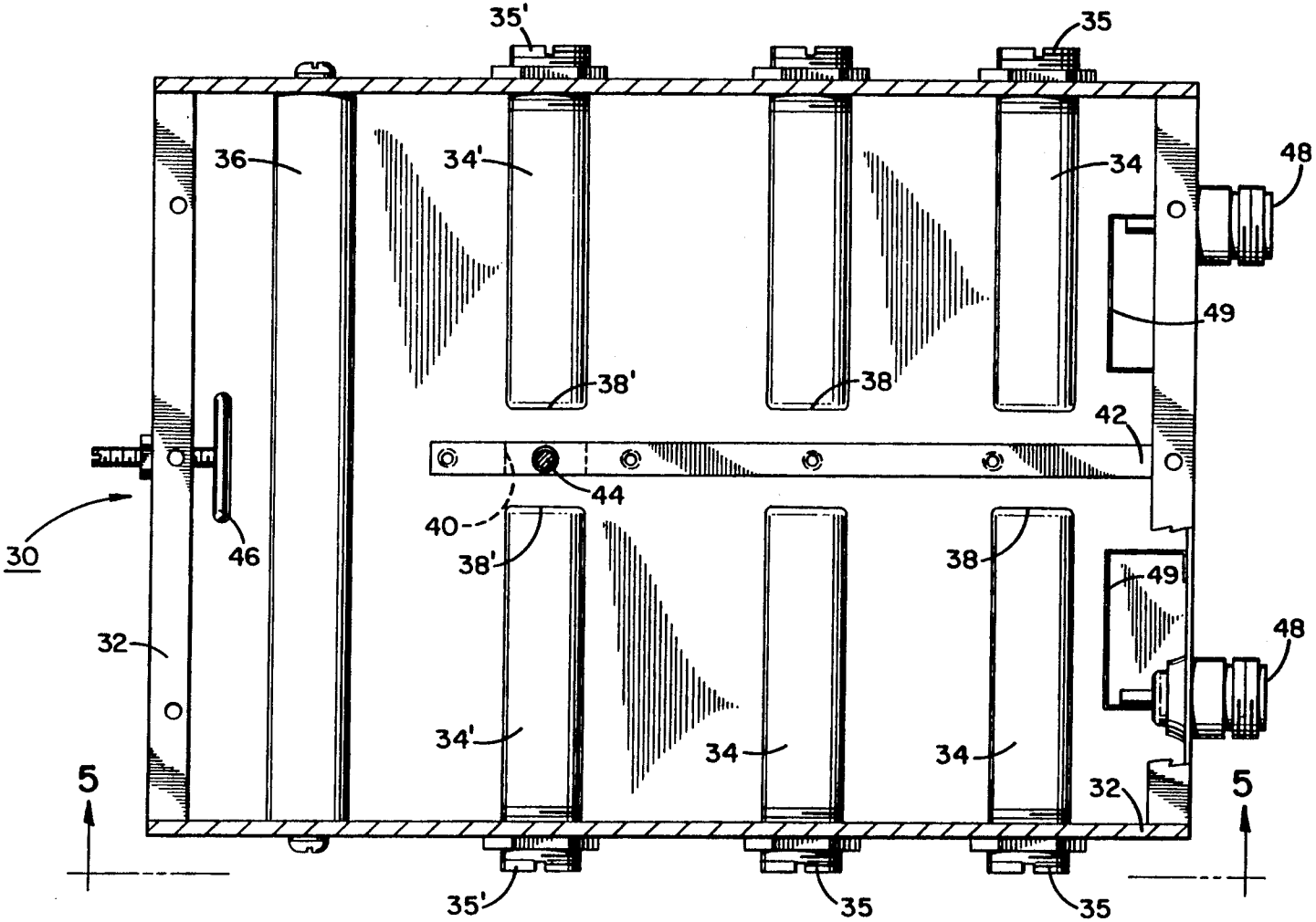
FIG. 4 is a top plan view of a half-wave folded cross-coupled high frequency resonant cavity filter using a shunt half-wave resonator rod according to the present invention taken along line 4—4 of FIG. 5 with a portion of the housing broken away to illustrate internal structure.

Referring first to FIGS. 1, 2, and 3, there is illustrated a prior art folded cross-coupled high frequency resonant cavity filter, generally indicated by the numeral 10. This filter 10 has a plurality of resonator rods 14, 16, 24 that are mounted therein. These resonator rods 14, 16, 24 are fine-tuned by tuning rods 26. The majority of the resonator rods 14, 16, 24 are physically separated by an inner housing wall 18. Two of the resonator rods 14, 16 that are separated by the inner housing wall 18 maintain a pair of coupling probes 12, 20 so as to allow capacitive cross-coupling. Each coupling probe 12, 20 is mounted directly to its respective resonator rod 14, 16 across an opening 22 in the inner housing wall 18, thereby creating a capacitive coupling between the resonator rods 14, 16. As previously stated in the prior art description, these coupling probes 12, 20 result in degradation to resonator Q and are difficult to securely attach to the resonator rods 14, 16.

It can also be seen from FIGS. 1, 2, and 3, that the resonator rods 14, 16, 24 in the prior art folded filter 10 are positioned along two separate vertical planes that are parallel to one another. This parallel plane positioning results in the filter 10 consuming a large amount of vertical space. Thus, the amount of vertical space consumed by the prior art folded filter 10 has an undesirable effect when several of these filters are to be stacked in a limited vertical space environment.

Figure 5:
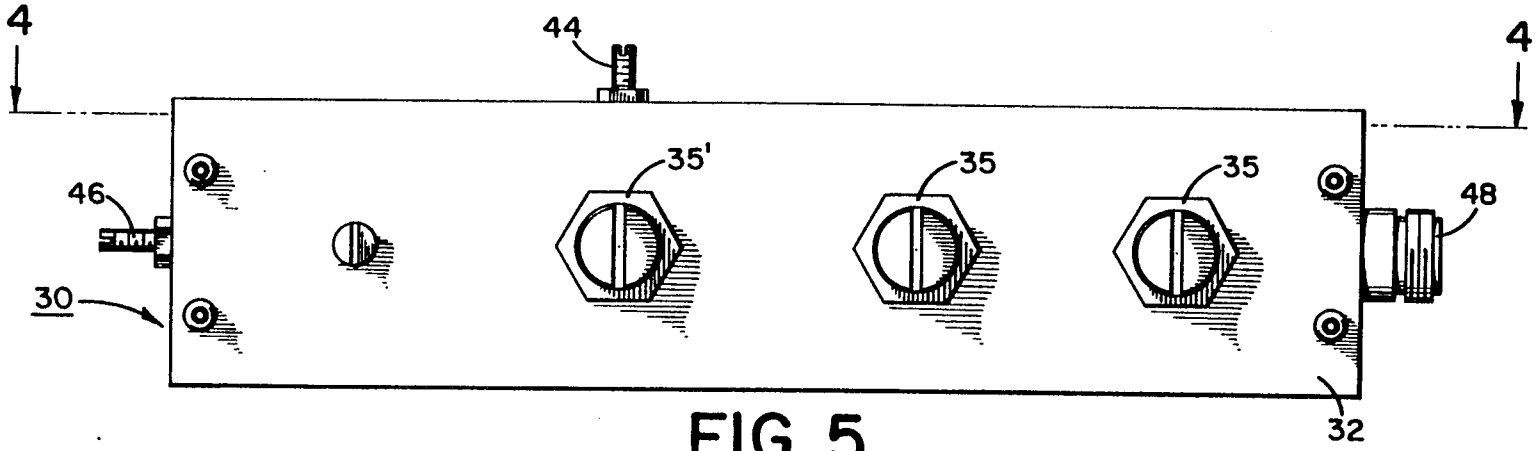
FIG. 5 is a side elevational view of a half-wave folded cross-coupled high frequency resonant cavity filter using a shunt half-wave resonator rod taken along line 5—5 of FIG. 4.

Referring now to FIGS. 4 and 5, there is shown a first embodiment of a half-wave folded cross-coupled high frequency resonant cavity filter according to the present invention, generally indicated by the numeral 30. In this filter 30, a housing 32 contains a plurality of evanescent mode resonator rods 34, 34' cantilevered therein, and a shunt half-wave resonator rod 36 extending thereacross. Input and output ports 48 are supplied with coupling loops 49 to allow input and output coupling, respectively, with the resonator rods 34, 34', 36. As is well-known in the art, the evanescent mode resonator rods 34, 34' do not require tuning rods as they are fine tuned by threading the rods 34, 34' into or out of the filter housing 32 using screws 35 on the ends thereof, thereby increasing or decreasing the length of the rods 34, 34'. As the length of a resonator rod 34, 34' is increased, a capacitance to ground between the free end 38, 38' of the resonator rod 34, 34' and an inner housing wall 42 is also increased. Thus, the use of the evanescent mode resonator rods 34, 34' reduces the total number of parts that are required for tuning.

Figure 13:
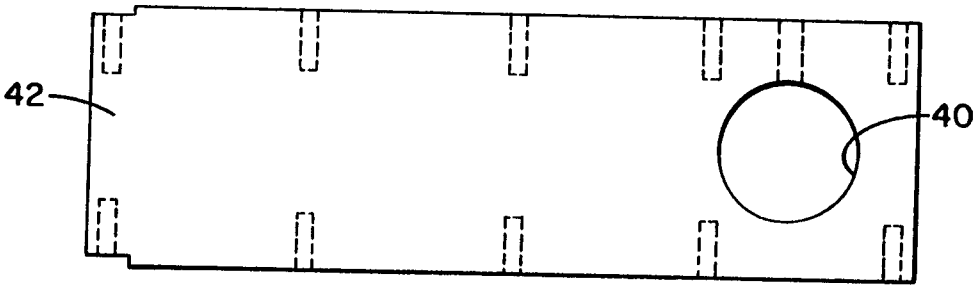
FIG. 13 is a side elevational view of the inner housing wall of the half-wave folded cross-coupled high frequency resonant cavity filters of FIGS. 4 and 5.

The use of the shunt half-wave resonator rod 36 allows all of the resonator rods 34, 34', 36 to lie in the same vertical plane, thereby reducing the overall amount of vertical space required by the filter 30. Also, since the longitudinal axes of all the evanescent mode resonator rods 34, 34' lie along the same vertical plane, capacitive cross-coupling can be easily attained by forming an aperture 40 (see FIGS. 4 and 13) in the inner housing wall 42. This capacitive cross-coupling occurs between the two resonator rods 34' that are physically opposing each other across the aperture 40. The free ends 38' of these two opposing resonator rods 34' form a parallel plate capacitor through the aperture 40. The size of the aperture 40 is such to allow slightly more capacitance than is actually required. A tuning rod 44 is then positioned through the inner housing wall 42 and into the aperture 40 so as to fine tune the cross-coupled capacitance. The shunt half-wave resonator rod 36 is fine tuned by a tuning disc 46 that creates a capacitance to ground at the center of the shunt half-wave resonator rode 36.

Figure 6:
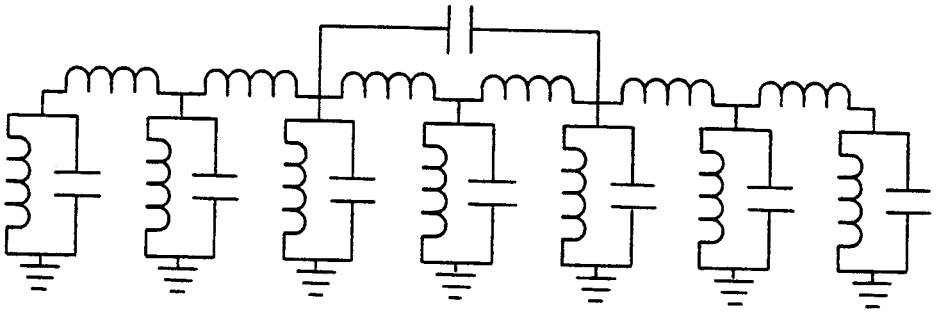
FIG. 6 is a lumped element equivalent circuit of the half-wave folded cross-coupled high frequency resonant cavity filter shown in FIGS. 4 and 5.
Figure 7:
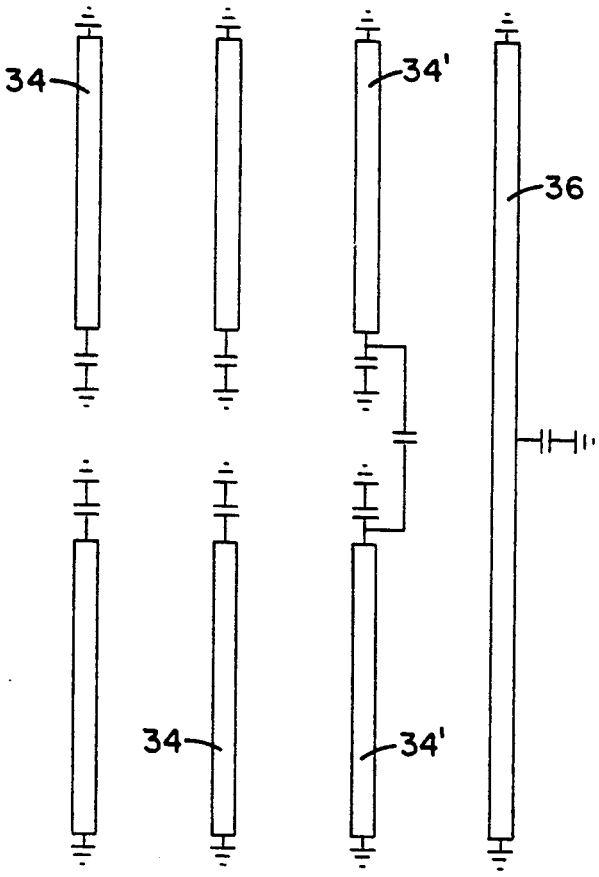
FIG. 7 is a coupled line equivalent structure of the half-wave folded cross-coupled high frequency resonant cavity filter shown in FIGS. 4 and 5.

Capacitive cross-coupling is desirable because it creates an equivalent series-connected parallel L-C resonance. Such coupling causes a notch to occur in the frequency response of the filter 30 at this resonance. A lumped element equivalent circuit of this filter 30 is shown in FIG. 6. A coupled line equivalent structure of this filter 30 is shown in FIG. 7.

Figure 8:
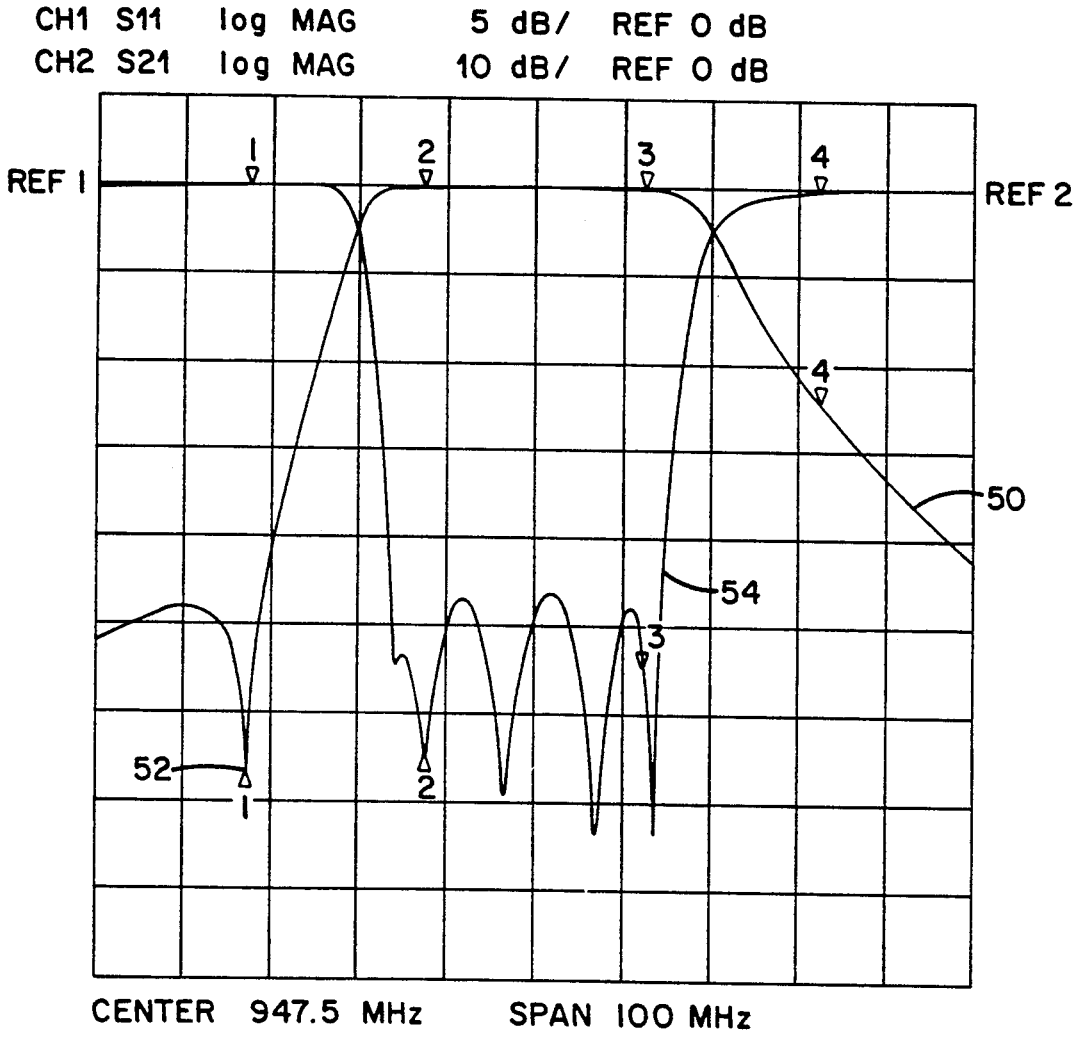
FIG. 8 is a graph showing the frequency response and insertion loss of a five pole half-wave folded cross-coupled high frequency resonant cavity filter using a shunt half-wave resonator rod.

The use of the shunt half-wave resonator rod 36 in the filter 30 in FIGS. 4 and 5 results in the frequency of the L-C resonance created notch being below the passband of the filter 30. This occurs because of an inductive impedance of the shunt half-wave resonator rod 36 below the passband. This effect is illustrated in FIG. 8, where a first curve 50 indicates the frequency response of a five pole filter using a shunt half-wave resonator rod. As can be seen, a notch 52 occurs below the passband (from 935 mHz to 960 mHz). A second curve 54 indicates the return loss of the five pole filter.

Figure 10:
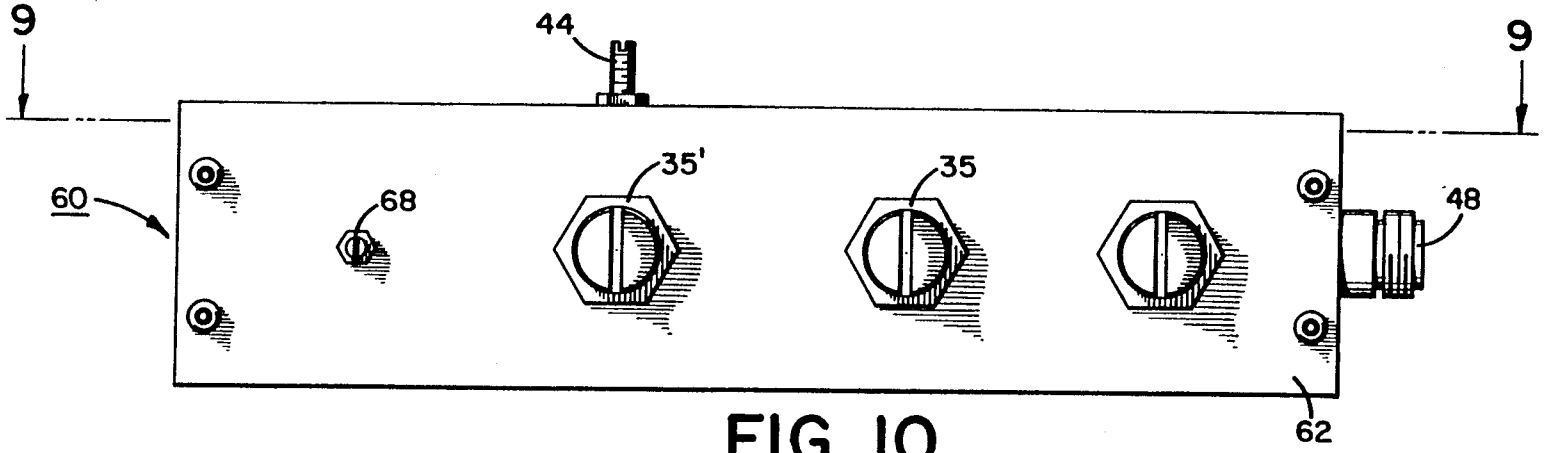
FIG. 10 is a side elevational view of a half-wave folded cross-coupled high frequency resonant cavity filter using a series half-wave resonator rod taken along line 10—10 of FIG. 9.
Figure 9:
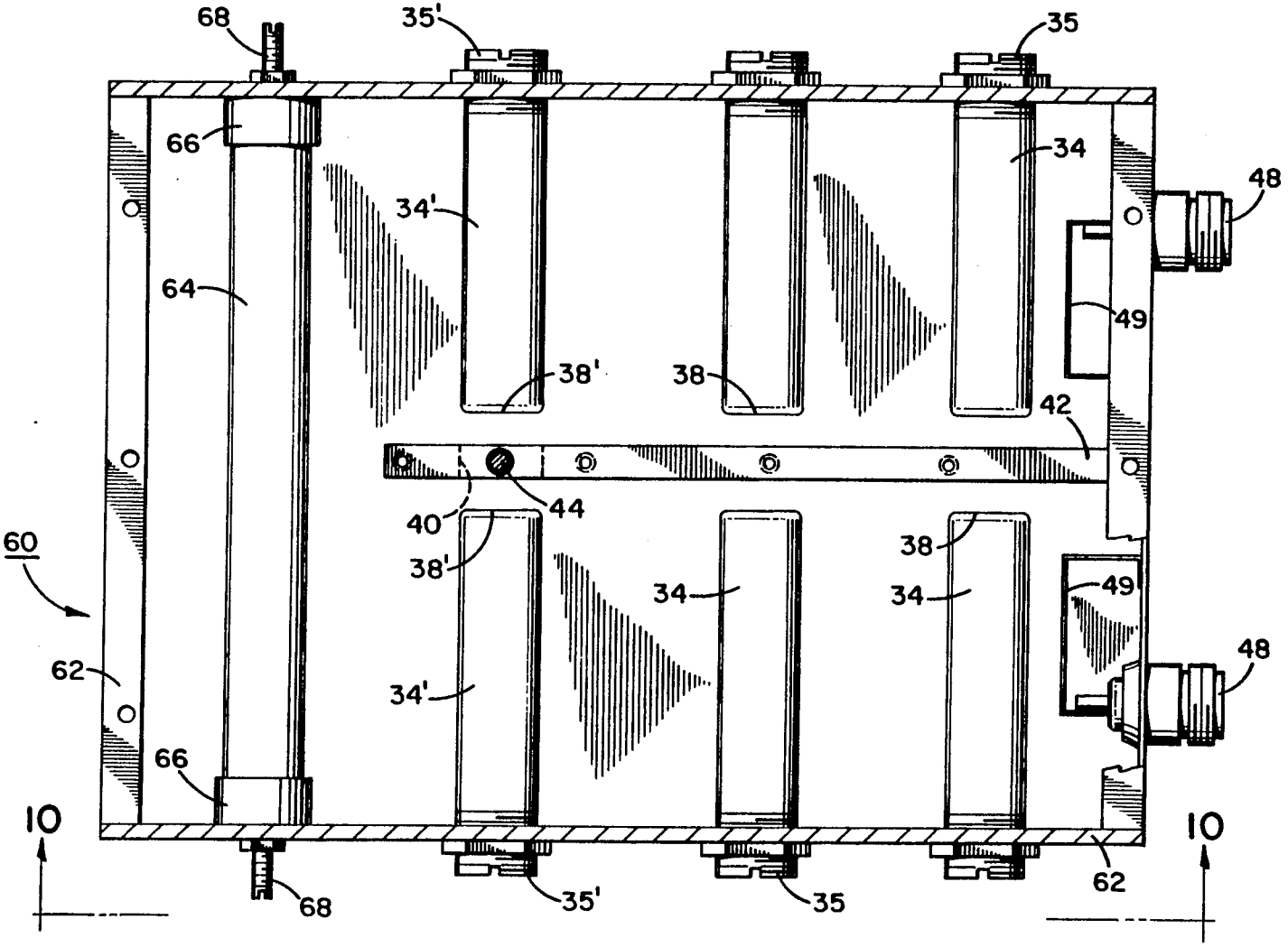
FIG. 9 is a top plan view of a half-wave folded cross-coupled high frequency resonant cavity filter using a series half-wave resonator rod taken along line 9—9 of FIG. 10 with a portion broken away to illustrate internal structure.

In FIGS. 9 and 10, there is shown a second embodiment of a half-wave folded cross-coupled high frequency resonant cavity filter according to the present invention, generally indicated by the numeral 60. In this filter 60, a housing 62 similarly contains the same elements that are in the filter 30 in FIGS. 4 and 5, except that a series half-wave resonator rod 64 is used instead of a shunt half-wave resonator rod 36. Similar elements are designated by like numerals and have similar operation. The series half-wave resonator rod 64 is supported on both ends by a pair of dielectric sleeves 66. Thus, both ends of the series half-wave resonator rod 64 from parallel plate capacitors to ground with the filter housing 62. A pair of tuning rods 68 are used to fine tune the series half-wave resonator rod 64 by creating a capacitance to ground at both ends of the series half-wave resonator rod 64.

Figure 11:
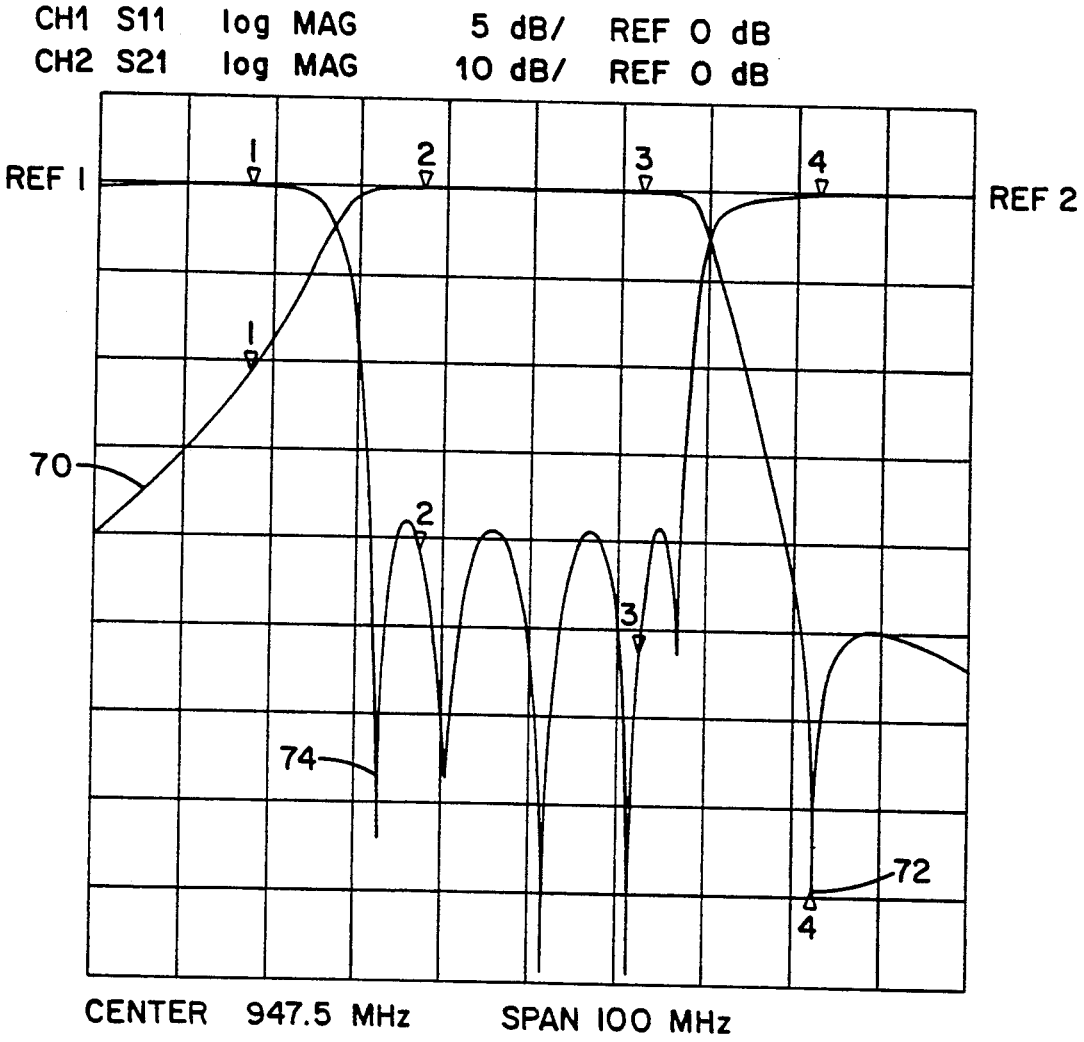
FIG. 11 is a graph showing the frequency response and insertion loss of a five pole half-wave folded cross-coupled high frequency resonant cavity filter using a series half-wave resonator rod.

The use of the series half-wave resonator rod 64 produces a different effect as to the location of the L-C resonance notch created by the capacitive cross-coupling of the evanescent mode resonator 34'. Due to an inductive impedance of the series half-wave resonator rod 64 being above the filter passband, the frequency of the L-C resonance notch is above the passband. This effect is illustrated in FIG. 11, where a first curve 70 indicates the frequency response of a five pole filter using a series half-wave resonator rod. As can be seen, a notch 72 occurs above the passband (from 935 mHz to 960 mHz). A second curve 74 indicates the return loss of the five-pole filter.

Figure 12:
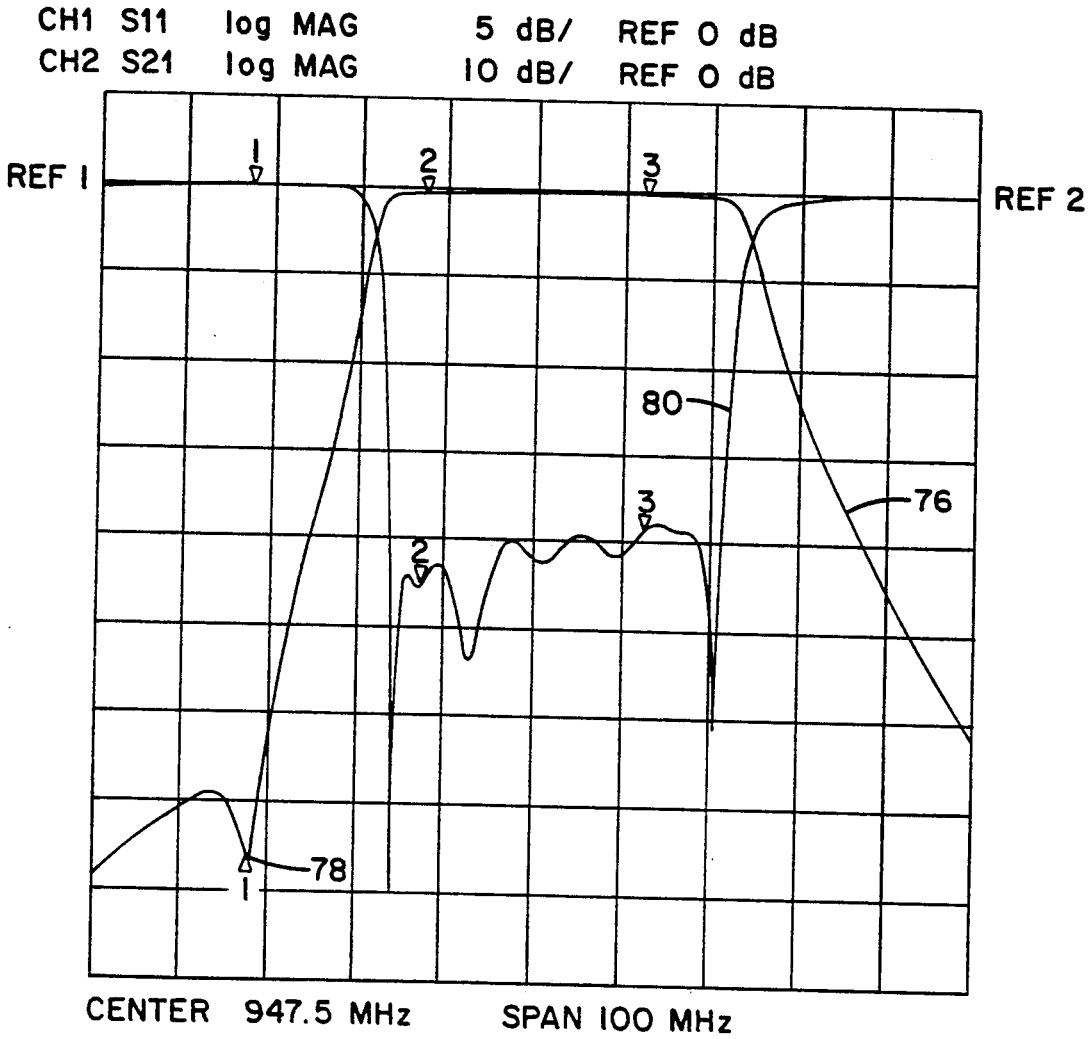
FIG. 12 is a graph showing the frequency response and insertion loss of the seven pole half-wave folded cross-coupled high frequency resonant cavity filter shown in FIGS. 4 and 5.

Referring to FIG. 12, there is shown a graph illustrating the frequency response and insertion loss of the seven pole half-wave folded cross-coupled filter 30 in FIGS. 4 and 5. A first curve 76 indicates the frequency response of the filter 30. Since the filter 30 uses a shunt half-wave resonator rod 36, a notch 78 is produced below the filter passband (from 935 mHz to 960 mHz). A second curve 80 indicates the return loss of the seven pole filter 30.

It is thus seen that the objectives set forth above are efficiently attained and, since certain changes may be made in the above described filter without departing from the scope of the invention, it is intended that all matter contained in the above description or shown in the accompanying drawings shall be interpreted as illustrative and not in a limiting sense.

What is claimed is:

1. A folded high frequency resonant cavity filter, wherein said filter is folded through the use of a half-wave resonator rod mounted within said filter, and wherein said folding allows a plurality of evanescent mode resonator rods to be mounted physically opposing each other within said filter so as to allow cross-coupling between said plurality of physically opposing mounted evanescent mode resonator rods, said filter comprising:

a filter housing;

a half-wave resonator rod mounted within said filter housing so as to allow said filter to be folded;

a plurality of evanescent mode resonator rods mounted within said housing, wherein said folding allows at least two of said plurality of evanescent mode resonator rods to be mounted physically opposing each other within said filter housing so as to allow cross-coupling between said at least two physically opposing evanescent mode resonator rods; and means for providing an input and an output connection to said filter.

2. The folded high frequency resonant cavity filter as defined in claim 1, wherein said half-wave resonator rod and said plurality of evanescent mode resonator rods are mounted within said housing such that said half-wave resonator rod and said plurality of evanescent mode resonator rods all lie along a single plane.

3. The folded high frequency resonant cavity filter as defined in claim 2, wherein said filter housing contains an inner housing wall, and wherein said inner housing wall acts to physically isolate a first group of said plurality of evanescent mode resonator rods from a second group of said plurality of evanescent mode resonator rods.

4. The folded high frequency resonant cavity filter as defined in claim 3, wherein said inner housing wall defines at least one aperture therein, wherein each aperture is formed such that a free end of one evanescent mode resonator rod from said first group of said plurality of evanescent mode resonator rods and a free end of one evanescent mode resonator rod from said second group of said plurality of evanescent mode resonator rods are physically opposing each other across each said aperture, and wherein said physically opposing evanescent mode resonator rod ends form a parallel plate capacitor such that a capacitive cross-coupling occurs between each of said evanescent mode resonator rods with said physically opposing free ends.

5. The folded high frequency resonant cavity filter as defined in claim 4, wherein a tuning rod is positioned within each said aperture so as to fine tune said capacitive cross-coupling.

6. The folded high frequency resonant cavity filter as defined in claim 5, wherein said half-wave resonator rod is a shunt half-wave resonator rod, and wherein said shunt half-wave resonator rod is electrically shorted to said filter housing.

7. The folded high frequency resonant cavity filter as defined in claim 6, wherein said shunt half-wave resonator rod is electrically shorted to said filter housing at both ends of said shunt half-wave resonator rod.

8. The folded high frequency resonant cavity filter as defined in claim 7, wherein said shunt half-wave resonator rod is fine tuned by a tuning disc, and wherein said tuning disc creates a capacitance to ground at the center of said shunt half-wave resonator rod.

9. The folded high frequency resonant cavity filter as defined in claim 8, wherein said capacitive cross-coupling between each of said evanescent mode resonator rods with said physically opposing free ends creates a notch in the frequency response of said filter, and wherein said shunt half-wave resonator rod causes said notch to occur below the passband of said filter.

10. The folded high frequency resonant cavity filter as defined in claim 5, wherein said half-wave resonator rod is a series half-wave resonator rod, and wherein said series half-wave resonator rod is electrically isolated from said filter housing.

11. The folded high frequency resonant cavity filter as defined in claim 10, further including a pair of dielectric sleeves which support both ends of said series half-wave resonator rod within said filter housing and isolate said series half-wave resonator rod from said filter housing.

12. The folded high frequency resonant cavity filter as defined in claim 11, further including a pair of tuning rods for fine tuning said series half-wave resonator rod, wherein said pair of tuning rods create a capacitance to ground at both ends of said series half-wave resonator rod.

13. The folded high frequency resonant cavity filter as defined in claim 12, wherein said capacitive cross-coupling between each of said evanescent mode resonator rods with physically opposing ends creates a notch in the frequency response of said filter, and wherein said series half-wave resonator rod causes said notch to occur above the passband of said filter.

14. The folded high frequency resonant cavity filter as defined in claim 1, wherein said means for providing an input and an output connection to said filter is an input port and an output port.

15. A folded high frequency resonant cavity filter as defined in claim 14, wherein said input port and said output port are both supplied with a coupling loop so as to allow input coupling and output coupling, respectively, with said filter.

* * * * *